US008170877B2

(12) United States Patent
Agapi et al.

(10) Patent No.: US 8,170,877 B2
(45) Date of Patent: May 1, 2012

(54) PRINTING TO A TEXT-TO-SPEECH OUTPUT DEVICE

(75) Inventors: Ciprian Agapi, Lake Worth, FL (US); Oscar J. Blass, Boynton Beach, FL (US); Charles T. Rutherfoord, Delray Beach, FL (US)

(73) Assignee: Nuance Communications, Inc., Burlington, MA (US)

( * ) Notice: Subject to any disclaimer, the term of this patent is extended or adjusted under 35 U.S.C. 154(b) by 939 days.

(21) Appl. No.: 11/156,958

(22) Filed: Jun. 20, 2005

(65) Prior Publication Data

US 2006/0287860 A1 Dec. 21, 2006

(51) Int. Cl.
*G10L 13/08* (2006.01)

(52) U.S. Cl. ..... 704/260; 704/270.1; 704/271

(58) Field of Classification Search ..... None
See application file for complete search history.

(56) References Cited

U.S. PATENT DOCUMENTS 4,692,941 A 9/1987 Jacks et al.
4,996,707 A * 2/1991 O'Malley et al. ..... 379/100.13
5,149,211 A 9/1992 Pettigrew et al.
6,230,127 B1 5/2001 Imade
2001/0051874 A1 12/2001 Tsuji
2004/0003136 A1* 1/2004 Murawski et al. ..... 709/327
2004/0015988 A1* 1/2004 Venkataraman ..... 725/38
2004/0128200 A1 7/2004 Sacks et al.
2004/0181747 A1* 9/2004 Hull et al. ..... 715/500.1
2004/0186713 A1* 9/2004 Gomas et al. ..... 704/235
2005/0068581 A1* 3/2005 Hull et al. ..... 358/1.16
2005/0068584 A1* 3/2005 Kawaoka ..... 358/1.18

* cited by examiner

*Primary Examiner* — Leonard Saint Cyr
(74) *Attorney, Agent, or Firm* — Wolf, Greenfield & Sacks, P.C.

(57) ABSTRACT

A method for producing speech output can include the step of selecting a TTS output device from a plurality of available output devices. The selected output device can be associated with outputting content of an application responsive to a print command. According to the method, the print command can be detected, which results in the content of the application being conveyed to the selected TTS output device. The TTS output device can be associated with at least one text-to-speech engine. Upon content conveyance to the TTS output device, at least a portion of the content can be automatically converted using the text-to-speech engine. The speech converted content can be outputted.

19 Claims, 3 Drawing Sheets

PRINTING TO A TEXT-TO-SPEECH OUTPUT DEVICE

BACKGROUND

1. Field of the Invention

The present invention relates to the field of speech processing and, more particularly, to opening more applications to speech synthesis by using a printer driver architecture as a mechanism to feed data to a text-to-speech engine.

2. Description of the Related Art

Many applications include text-to-speech (TTS) processing capabilities, which permit each application to audibly present machine generated speech that has been automatically constructed from textual content present within the application. This TTS processing capability is especially useful for visually impaired computer users that have difficulty interpreting visually displayed content and for users of mobile and embedded computing devices, where the mobile and embedded computing devices may either lack a screen, possess a tiny screen unsuitable for displaying large amounts of content, or can used in an environment where it is not appropriate for a user to visually focus upon a display. An inappropriate environment can include, for example, a vehicle navigation environment, where outputting navigation information to a display for viewing can be distracting to a driver.

For most of these applications having TTS capabilities, the computer readable instructions responsible for providing the TTS processing capabilities are embedded within the code of the application itself, and can be accessed through a user interface specific to the application. For example, an "options" menu under a "tools" heading can open an interface dialogue box through which an application's TTS capabilities can be configured by a user.

Unfortunately, many applications lack text-to-speech capabilities. Notably included in these applications currently lacking TTS capabilities is a popular PDF reader and many text editing and word processing programs, such as the NOTEPAD application and the WORDPAD application. It is very cumbersome if not impossible for a user to convert content within an application that lacks integrated TTS capabilities into speech output.

For example, one technique to generating speech output is to "cut and paste" content from a first application that lacks TTS capabilities to a second application that includes TTS capabilities. After pasting the content into the second application, the TTS capabilities of the second application can be used to generate speech output. This approach is inefficient, is subject to manual user errors during the cut and paste process, consumes substantial computing resources such as RAM, requires a user to possess an application with TTS capabilities, and is generally cumbersome to implement.

Another approach is to generate a file in a format of the first application and to convert this file using a conversion application into an audio format, where the converted file includes encoded speech which has been generated by a speech-to-text engine based upon the content of the original file. For example, conversion programs exist that convert PDF formatted documents into MP3 formatted audio files, where TTS conversion of textual content included within the PDF file occurs during the conversion process.

The conversion approach has numerous shortcomings. First, the solution is limited to particular types of file formats, such as PDF formatted documents and MP3 formatted documents, and cannot be generally applied to in a file-format independent manner. Second, the solution requires a user to perform multiple steps that include: (1) saving content included within an open application to a file, (2) instantiating a conversion application, (3) selecting the saved file from the conversion application and providing a name and location for the new file, (4) executing the file conversion operation, and (5) using a third application to open the newly converted file, where the third application audibly presents the text-to-speech converted content. Consequently, like the cut and paste method, the file conversion method is inefficient and cumbersome for a user to utilize.

SUMMARY OF THE INVENTION

The present invention discloses a technique for generating text-to-speech (TTS) converted output from content within an instantiated application, even though the application can lack inherent TTS capabilities. Specifically, a text-to-speech output device can be used to generate speech output from application content responsive to a print command. That is, the TTS output device can be implemented as a print driver. Any application having print capabilities can select the TTS output device as an active printer and can then send (via a print command) content to the TTS output device. In one embodiment, a plurality of user configurable setting can be established for the TTS output device to control the behavior of the TTS generated output. These user configurable settings can be integrated within existing interfaces present for printers. For example, the user configurable settings can be accessed using a printer properties tab associated with the TTS output device.

The present invention can be implemented in accordance with numerous aspects consistent with material presented herein. For example, one aspect of the present invention can include a method for producing speech output. The method can include the steps of selecting a TTS output device from a plurality of available output devices. The selected output device can be associated with outputting content of an application responsive to a print command. According to the method, the print command can be detected, which results in the content of the application being conveyed to the selected TTS output device. The TTS output device can be associated with at least one text-to-speech engine. Upon content conveyance, at least a portion of the content can be automatically converted using the text-to-speech engine. The speech converted content can be outputted.

Another aspect of the present invention can include a graphical user interface comprising a printer selection dialog box. The printer selection dialog box can be configured to present a plurality of user-selectable printers. A user selection of one of the printers can cause the selected printer to be associated with a print command. Detection of the print command can result in content being conveyed to the selected printer. The printer selection dialog box can include at least one text-to-speech output device. The text-to-speech output device can be associated with a print driver compatible with other print drivers associated with the user-selectable printers. Detection of the print command when the text-to-speech output device is the selected printer can result in text contained within the conveyed content being text-to-speech converted and can result in text-to-speech converted output being audibly presented.

Still another aspect of the present invention can include a print driver comprising a software driver for a text-to-speech output device. The software driver can permit the text-to-speech output device to be selected as a printer. When selected as a printer and when initiated responsive to a print command, the text-to-speech output device can cause a least a textual portion of content selected for printing to be text-to-speech converted. The text-to-speech converted output can be audibly presented via an audio transducer.

It should be noted that various aspects of the invention can be implemented as a program for controlling computing equipment to implement the functions described herein, or a program for enabling computing equipment to perform processes corresponding to the steps disclosed herein. This program may be provided by storing the program in a magnetic disk, an optical disk, a semiconductor memory, any other recording medium, or can also be provided as a digitally encoded signal conveyed via a carrier wave. The described program can be a single program or can be implemented as multiple subprograms, each of which interact within a single computing device or interact in a distributed fashion across a network space.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

Figure 1:
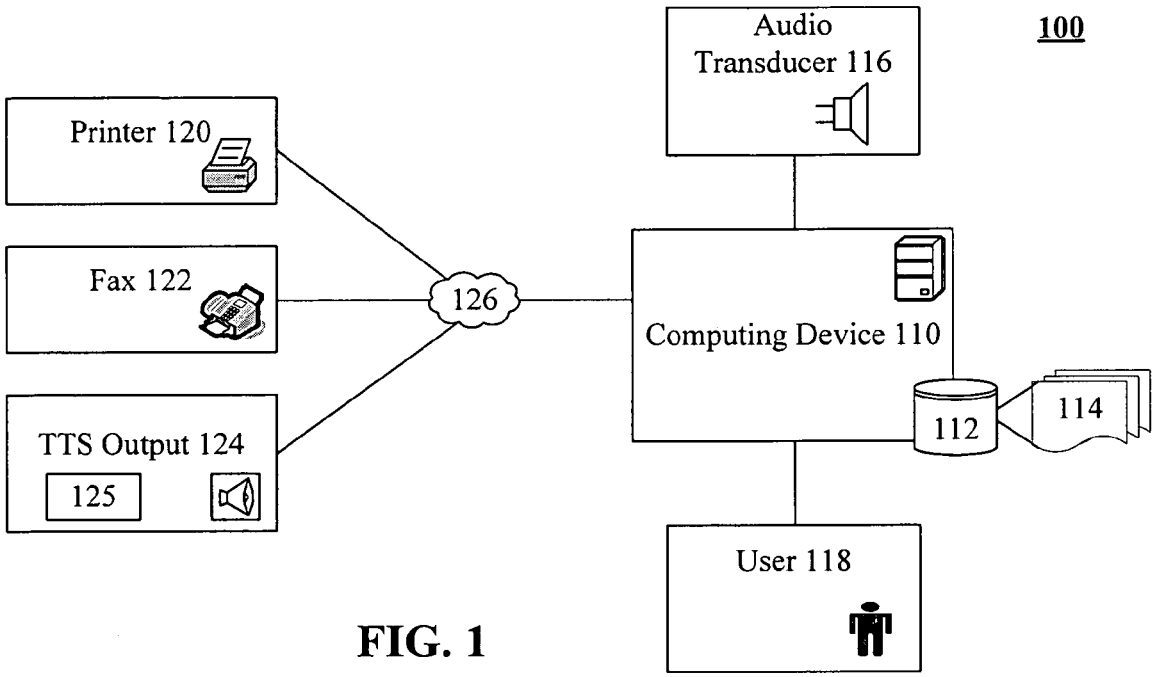
FIG. 1 is a schematic diagram of a system in which printed content can be directed to a text-to-speech output device in accordance with an embodiment of the inventive arrangements disclosed herein.

FIG. 1 is a schematic diagram of a system 100 in which printed content can be directed to a text-to-speech (TTS) output device in accordance with an embodiment of the inventive arrangements disclosed herein. System 100 can include a computing device 110 linked to a plurality of output devices including printer 120, fax 122, and TTS output device 124. Each output device can be a peripheral device of computing device 110 or can be a networked device accessible over network 126.

The computing device 110 can include one or more drivers 114 stored within a data store 112. Each of the drivers 114 can be a program designed to interface a device. For example, the drivers 114 can include print drivers for interfacing with printer 120, fax 122, and TTS output device 124. In another example, the drivers can include keyboard drivers that permit the operating system of the computing device 110 to interface with an attached keyboard.

A user 118 of computing device 110 can issue a print command, which conveys content to be printed to a selected output device. For example, when the output device is printer 120, content can be conveyed from an application from which the print command was issued and sent to printer 120. The conveyance of content can be handled in accordance with specification defined by a print driver 114 associated with printer 120. The printer 120 can then print the content to paper or other print medium, such as a printable photograph paper, an envelope, or card stock.

When the selected output device associated with the print command is TTS output device 124, content can be conveyed to the TTS output device 124 in a manner specified by a driver 114 associated with TTS output device 124. Upon receiving the content, TTS output device 124 can TTS convert at least a portion of the received content from text into speech utterances. In one embodiment, the TTS output device 124 can utilize a TTS engine 125 to perform the TTS conversion operation. The TTS engine 125 can be a software program residing upon or local to the TTS output device 124 or can be a remotely located software program accessible to the TTS output device 124.

Once the TTS output device 124 generates speech utterances, the speech utterances can be audibly presented to user 118 via an audio transducer 116, such as a speaker. In one embodiment, instead of being audibly presented to user 118, the TTS engine can generate an audibly formatted file that includes the TTS utterances. For example, the TTS output can be digitally encoded within a file in an MP3 or other audio format. The location that the generated file is stored within can be a default location of a location specified by user 118. In yet another embodiment, the output from TTS output device 124 can be both audibly presented via audio transducer 116 and can be conveyed to a designated file containing the digitally encoded TTS generated speech. Output preferences can be user configurable preferences that user 118 established for TTS output device 114.

It should be appreciated that not all of the content received by the TTS output device 124 is necessarily converted into speech. For example, in one embodiment, only textually formatted content can be TTS converted, while other content can be ignored by the TTS output device 124. In another embodiment, graphically formatted content can be searched for textual sections, located textual section can be converted to text using optical character recognition (OCR) technologies, and then OCR recognized text can be converted to speech by the TTS output device 124. In still another embodiment, a series of user 118 configurable settings associated with the TTS output device 124 can determine the type of content that is to be TTS converted.

Figure 2:
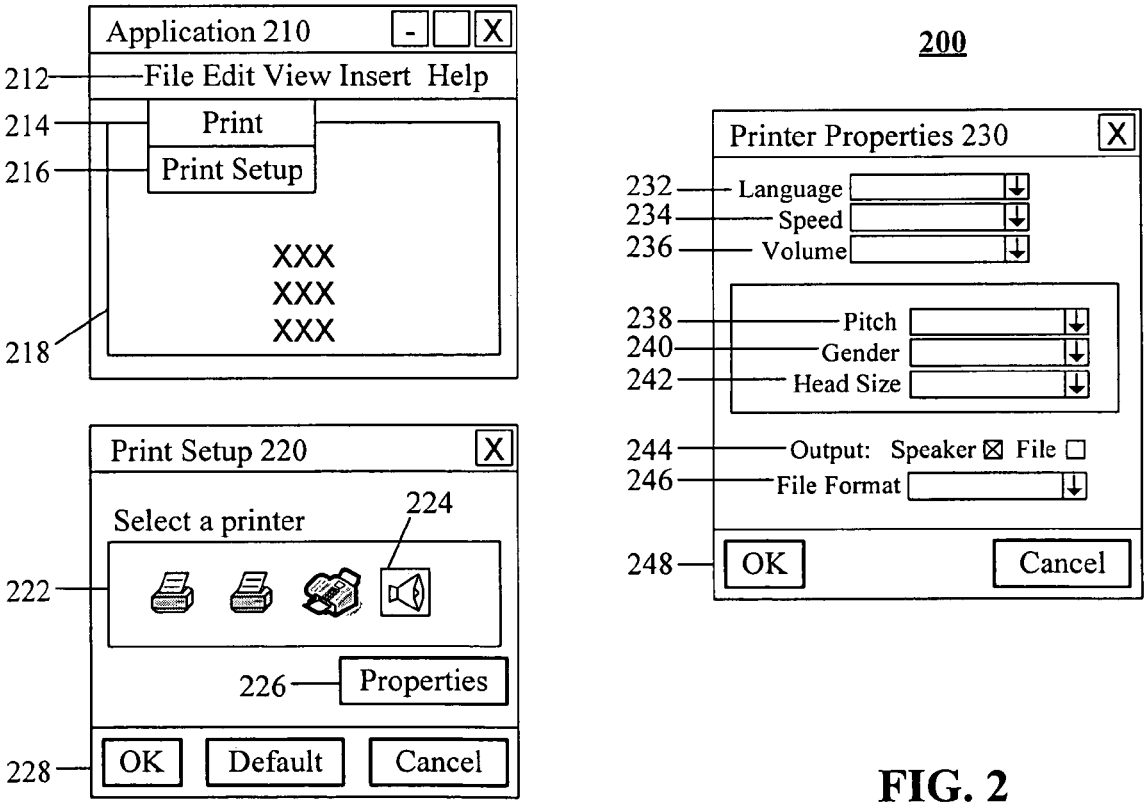
FIG. 2 is a Graphical User Interface (GUI) illustrating one contemplated interface for implementing a TTS output device as a print driver in accordance with an embodiment of the inventive arrangements disclosed herein.

FIG. 2 is a Graphical User Interface (GUI) 200 illustrating one contemplated interface for implementing a TTS output device as a print driver in accordance with an embodiment of the inventive arrangements disclosed herein. As illustrated, GUI 200 can include an application interface 210, a print setup interface 220, and a printer properties interface 230.

The application interface 210 can be an interface for an application that presents content 118 which can be printed. The application interface 210 can include, but is not limited to, a word processor application, a PDF reader, an html browser, a graphics application, and the like. The application interface 210 need not have application specific TTS capabilities included.

The application interface 210 can include a file menu 212 with menu options to print 214 and print setup 216. Print 214 can cause the content 218 to be conveyed to a selected output device or printer. Print setup 216 can allow for the selection of a desired printer from a list of available printers and can permit a user to adjust user configurable print settings.

Selection of print setup 216 can cause print setup interface 220 to appear. Print setup interface 220 can include a printer selection 222 area. One selectable printer within the printer selection area 222 can include TTS output device 224. A series of control buttons 228 can cause a selected printer to be utilized (OK button), can establish the selected printer as a default printer (Default button), and can cause the changes made via the print setup interface 220 to be discarded (Cancel button). A properties 226 control can also be included to allow a user to configure the properties of a selected printer.

Selection of the properties 226 control can cause printer properties interface 230 to appear. The printer properties interface 230 for the TTS output device can permit TTS settings to be adjusted. For example, the printer properties interface 230 can allow the language 232, speed 234, and volume 236 of TTS output to be adjusted. Controls for selectively modifying gender 238, pitch 240, and head size 242 can also be included in printer properties interface 230. Further, the interface 230 can permit a user to select an output type, such as outputting generated speech to a speaker, to a file, or both, as shown by controls 244. When a file output option is included, a further option for specifying a file format 246 can be provided. The file format can be any audio format including, but not limited to, MP3, AVI, WAV, OGG, VOX, WMA, and other such formats. Interface 230 can also include control buttons 248, which can cause the setting appearing within interface 230 to be applied (OK button) or discarded (cancel button).

It should be appreciated that the details contained within GUI 200 are for illustrative purposes only and the invention is not to be limited to the graphical elements illustrated herein. One of ordinary skill in the art knows that any number of interfaces, graphical and otherwise, can be used to implement the functionally demonstrated herein, all of which are included within the scope of the present invention. That is, the illustrated buttons, list boxes, text boxes, menus, and the like can each be implemented in a variety of ways based upon design preferences, each of these varieties being included within the contemplated scope of the present invention.

For example, in one embodiment (not shown) application interface 210 can be an audible interface instead of a graphical one, where speech commands, such as "print", can be spoken to initiate content output. In another example, the printer properties 230 can be established within an editable configuration file (not shown) associated with the TTS output device instead of being implemented as selectable options of a GUI.

Figure 3:
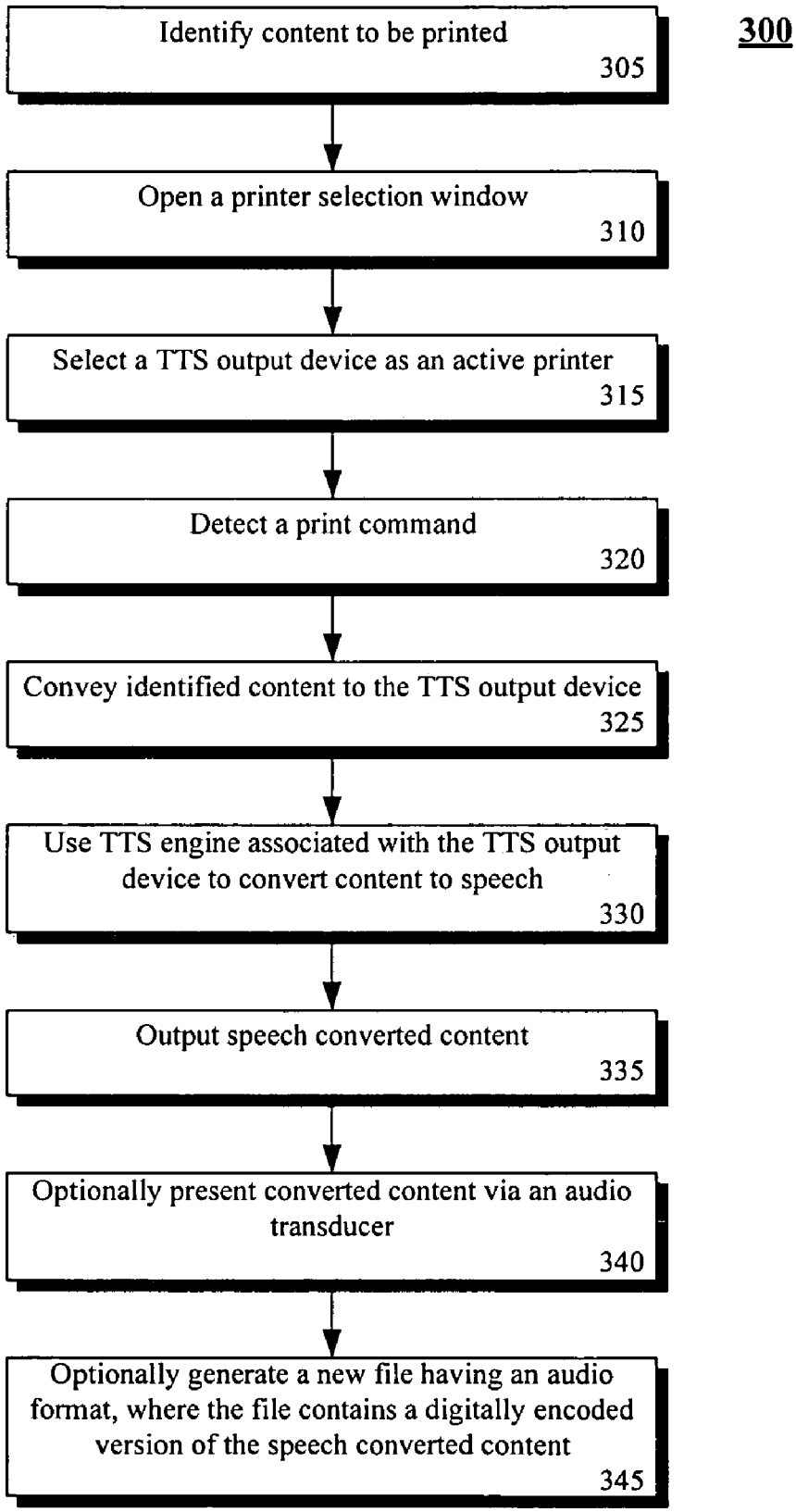
FIG. 3 is a flow chart of a method for printing output to a TTS output device in accordance with an embodiment of the inventive arrangements disclosed herein.

FIG. 3 is a flow chart of a method 300 for printing output to a TTS output device in accordance with an embodiment of the inventive arrangements disclosed herein. The method 300 can be performed in the context of any system including a TTS output device, such as system 100 or a system including GUI 200.

Method 300 can begin in step 305, wherein content to be printed can be identified. The content can be currently presented within an open application or selected in another fashion. For example, a file can be selected directly for printing from within a file management application. In step 310 a printer selection window can be opened. In step 315, a TTS output device can be selected as a printer for printing the identified content. Steps 310 and 315 are not necessary when a TTS output device has been previously selected as the default printer.

In step 320, a print command can be detected. In step 325, content identified for printing can be conveyed to the TTS output device. In step 330, a TTS engine associated with the TTS output device can be used to convert conveyed content to speech.

In step 335, speech converted content can be output in whatever manner is specified for the TTS output device. For example, in optional step 340, converted content can be audibly presented to a user via an audio transducer. In another example, in optional step 345, a new file having an audio format can be generated, where the new file contains a digitally encoded version of the speech converted content. After the speech converted output as been output, a user can continue to interact with a computer in a normal fashion, printing additional content to the TTS output device at will.

Figure 4:
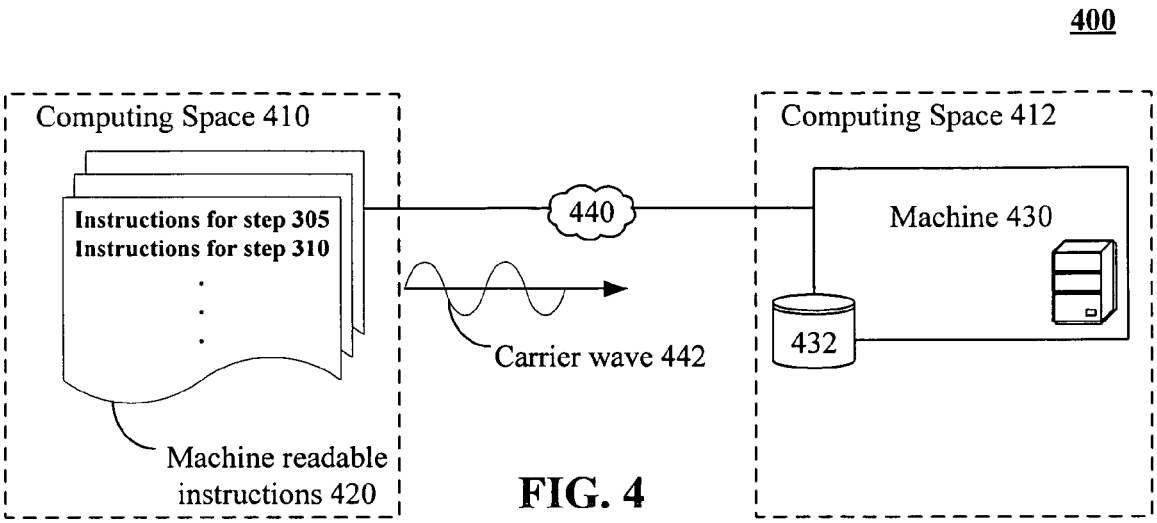
FIG. 4 is a schematic diagram of a system emphasizing details of an environment in which the method of FIG. 3 can be implemented in accordance with an embodiment of the inventive arrangements disclosed herein.

FIG. 4 is a schematic diagram of a system 400 emphasizing details of an environment in which the method 300 can be implemented in accordance with an embodiment of the inventive arrangements disclosed herein. System 400 includes a plurality of machine readable instructions 420 that can be executed by machine 430. The machine readable instructions 420 can enable the machine 430 to perform the steps of method 300 and/or portions thereof. For example, a portion of the machine readable instructions 420 can direct machine 430 to perform step 305, while a different portion can direct machine 430 to perform step 310.

The machine readable instructions 420 can include one or more organized groupings of programmatic code. The programmatic code can be written in any of a variety of computer languages, such as JAVA, C, C++, FORTRAN, VISUAL BASIC, and the like. In one embodiment, the machine readable instructions 420 can be written in a single computing language. In another embodiment, the machine readable instructions 420 can be written in several different computing languages. Additionally, the programmatic code can be included within one or more software libraries, modules, routines, or sections.

The machine 430 that interprets the machine readable instructions 420 can be any of a variety of computing devices, such as a desktop computer, a server, a mobile electronic device, an electronic appliance, and embedded computing device, and the like. The machine 430 is not limited to a single computing device, but can also represent a two or more cooperating computing devices that are communicatively linked, each cooperating computing device executing a portion of the machine readable instructions 420.

The machine 430 can also include at least one data store 432 in which the machine readable instructions 420 can be stored. The data store 432 can include a persistent storage area, such as hard drive storage space, and/or a volatile storage area, such as RAM. The data storage 432 can be provided through any of a variety of storage mediums. For example, the data storage 432 can be provided via a magnetic medium, an optical medium, an electronic memory medium (such as FLASH memory or RAM), and combinations thereof. Additionally, the data storage 432 can utilize any data management technology including, but not limited to a file storage technology, an indexed sequential data storage technology, and relational database storage technologies.

In one embodiment, the machine readable instructions 420 need not be fixed within the data store 432, but can instead be provided in a piecemeal fashion to the machine 430 as required. That is, the complete set of machine readable instructions 420 need not reside within a computing space 412 in which the machine 430 operates in order for the machine 430 to perform the steps of method 300 in accordance with the machine readable instructions 420. Instead, the machine readable instructions can be located within a remotely located (meaning within a computing space not directly accessible by machine 430) computing space 410 and can be conveyed in a segmented fashion to computing space 412.

For example, a computing space 410 can provide different portions of the machine readable instructions 420 to computing space 412 via communication link 440 as needed. More specifically, the machine readable instructions 420 can be digitally encoded into a carrier wave 442. The carrier wave 442 can convey the digitally encoded information for performing the steps of method 300 between computing space 410 and computing space 412.

The communication link 410 over which the carrier wave 442 travels can represent any medium capable of conveying digitally encoded data. For example, the communication link 410 can include a data bus and/or a data cable that links various components of an integrated computing device to one another, such as the data bus that links a hard drive to a central processing unit. In another example, the communication link 410 can include a local area network, a wide area network, an intranet, or an internet.

The communication link can include line based communication pathways (such as a data cable or a network cable) as well as wireless communication pathways (such as a BLUETOOTH pathway, an 802.11 family based pathway, or a satellite based pathway).

Figure 5:
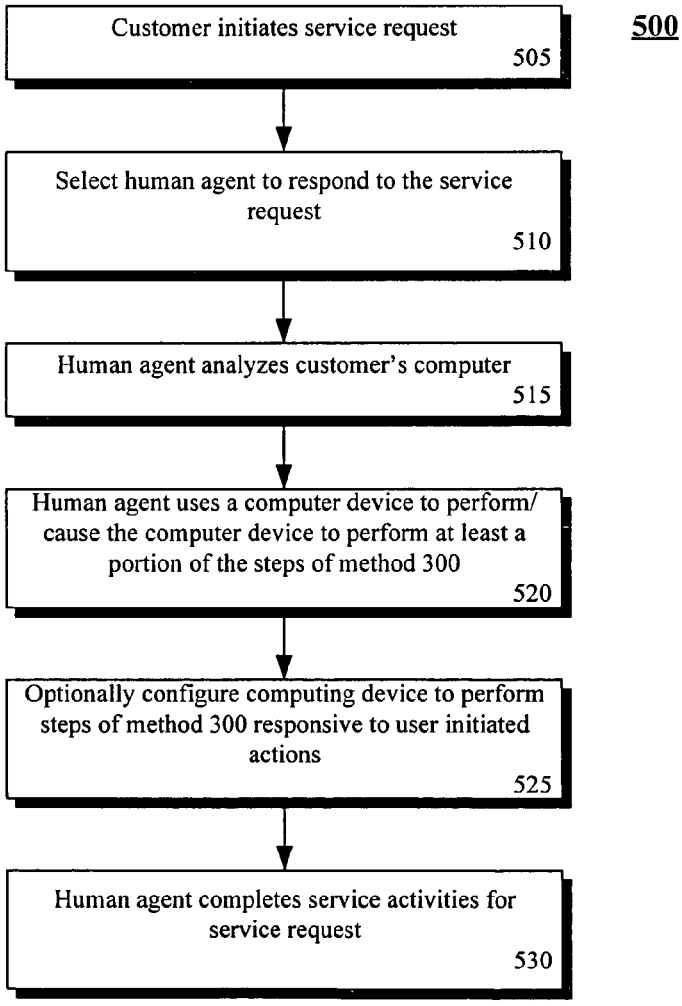
FIG. 5 is a flow chart for a method in which a human agent can perform one or more of the steps of the method of FIG. 3 in accordance with the inventive arrangements disclosed herein.

FIG. 5 is a flow chart for a method 500 in which a human agent can perform one or more of the steps of method 300 in accordance with the inventive arrangements disclosed herein. Method 500 can begin in step 505, where a customer can initiate a service request. The service request can, for example, indicate that the customer is having difficulty implementing a TTS output device upon the customer's computer. The service request can also be a more generically stated problem, which can be solved at least in part through the use of the TTS output device disclosed herein.

In step 510, a human agent can be selected to respond to the service request. In step 515, the human agent can analyze the customer's computer. In step 520, the human agent can use one or more computing devices to perform or to cause the computer device to perform the steps of method 300. For example, the human agent can install the TTS output device as an optional printer, can select the TTS output device, can initiate a print command, and can receive audible output of TTS converted content that has been "printed" to the TTS output device. Appreciably, the one or more computing devices used by the human agent can include the customer's computer, a mobile computing device used by the human agent, a networked computing device, and combinations thereof.

In optional step 525, the human agent can configure the customer's computer in a manner that the customer can perform the steps of method 300 in the future. For example, the human agent can install the TTS output device as a print driver and can select the TTS output device as a default printer for the customer's computer. Once the customer's machine has been configured by the human agent, the newly configured machine to perform the steps of method 300 responsive to customer initiated actions. In step 530, the human agent can complete the service activities having resolved the problem for which the service request was submitted.

It should be noted that while the human agent may physically travel to a location local to the customer's computer when responding to the service request, physical travel may be unnecessary. For example, the human agent can use a remote agent to remotely manipulate the customer's computer system in the manner indicated in method 500.

The present invention may be realized in hardware, software, or a combination of hardware and software. The present invention may be realized in a centralized fashion in one computer system, or in a distributed fashion where different elements are spread across several interconnected computer systems. Any kind of computer system or other apparatus adapted for carrying out the methods described herein is suited. A typical combination of hardware and software may be a general purpose computer system with a computer program that, when being loaded and executed, controls the computer system such that it carries out the methods described herein.

The present invention also may be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention may be embodied in other forms without departing from the spirit or essential attributes thereof. Accordingly, reference should be made to the following claims, rather than to the foregoing specification, as indicating the scope of the invention.

What is claimed is:

1. A method for producing speech data from content from any one of a plurality of applications, the method comprising:

in response to a print command, received from a user operating a computing device via a print interface accessed via one of the plurality of applications, to print the content, displaying a graphical user interface on a display of the computing device that provides a first option of outputting the content via a printer that is separate from the computing device and a second option of outputting the content via a text-to-speech output device capable of responding to the print command, the text-to-speech output device comprising a driver compatible with and configured to obtain the content via the print interface and a text-to-speech engine capable of converting text to speech, the print interface being generic to the plurality of applications;

displaying via the graphical user interface on the display of the computing device information identifying at least one user configurable setting of the text-to-speech output device;

in response to the user of the computing device altering the at least one user configurable setting via the graphical user interface, adjusting a corresponding operational parameter of the text-to-speech output device;

in response to the user selecting, via the print interface, the text-to-speech output device to output the content, receiving, by the driver, the content provided by the print interface and conveying, by the driver, at least a portion of the content to the text-to-speech engine;

automatically converting the portion of the content to speech data using the text-to-speech engine; and outputting the speech data.

2. The method of claim 1, wherein the print command is received from a user to print a file comprising the content, the file formatted according to an application that lacks text-to-speech conversion capabilities but includes print capabilities.

3. The method of claim 1, wherein the print interface includes a printer selection interface that displays a plurality of available devices capable of responding to the print command, and the at least one user configurable setting of the text-to-speech output device is displayed via a properties dialog box of the printer selection interface.

4. The method of claim 1, wherein the at least one user configurable setting comprises at least one among language, volume, speed, gender, pitch, and head size.

5. The method of claim 1, wherein outputting the speech data comprises outputting the speech data to a speaker.

6. The method of claim 1, wherein outputting the speech data comprises outputting the speech data to a file.

7. The method of claim 6, wherein outputting the speech data comprises outputting the speech data in accordance with a file format selected for the file from the printer selection interface.

8. The method of claim 7, wherein the file format includes at least one among MP3, AVI, WAV, OGG, VOX, and WMA.

9. The method of claim 1, further comprising filtering textually formatted content from the content and automatically converting only the textually formatted content to speech data.

10. The method of claim 1, further comprising locating a textual section from graphically formatted content and converting the located textual section to textual content using optical character recognition.

11. The method of claim 10, further comprising converting the textual content to speech data using the text-to-speech engine.

12. At least one non-transitory computer readable storage medium encoded with instructions that, when executed on at least one processor, performs a method for producing speech data from content from any one of a plurality of applications, the method comprising:

in response to a print command, received from a user operating a computing device via a print interface accessed via one of the plurality of applications, to print the content, displaying a graphical user interface on a display of the computing device that provides a first option of outputting the content via a printer that is separate from the computing device and a second option of outputting the content via-a text-to-speech output device capable of responding to the print command, the text-to-speech output device comprising a driver compatible with and configured to obtain the content from the print interface and a text-to-speech engine capable of converting text to speech, the print interface being generic to the plurality of applications;

displaying via the graphical user interface on the display of the computing device information identifying at least one user configurable setting of the text-to-speech output device;

in response to the user of the computing device altering the at least one user configurable setting via the graphical user interface, adjusting a corresponding operational parameter of the text-to-speech output device;

in response to the user selecting, via the print interface, the text-to-speech output device to output the content, receiving, by the driver, the content provided by the print interface and conveying, by the driver, at least a portion of the content to the text-to-speech engine;

automatically converting the portion of the content to speech data using the text-to-speech engine; and outputting the speech data.

13. A text-to-speech output device for producing speech data from content from any one of a plurality of applications in response to a print command received from a user operating a computing device via a print interface accessed via one of the plurality of applications, the text-to-speech output device comprising:

a driver compatible with the print interface and configured to communicate with the print interface, the print interface being generic to the plurality of applications, to obtain the content from the print interface when the user selects, via the print interface provided by the one of the plurality of applications, the text-to-speech output device to respond to the print command, wherein the print interface comprises a graphical user interface that presents to the user, on a display of the computing device, a first option of outputting the content via a printer that is separate from the computing device and a second option of outputting the content via the text-to-speech output device, and wherein the graphical user interface further presents to the user, on the display of the computing device, at least one user configurable setting of the text-to-speech output device, the driver being configured to adjust an operational parameter of the text-to-speech output device in response to a communication received from the print interface generated in response to the user of the computing device altering the at least one user configurable setting via the graphical user interface; and a text-to-speech engine coupled to the driver to receive from the driver at least a portion of the content to automatically convert the portion of the content to speech data.

14. The text-to-speech output device of claim 13, wherein:

the at least one user configurable setting comprises a plurality of user configurable settings associated with the text-to-speech output device, said user configurable settings are configurable as printer properties when the text-to-speech output device is selected as a printer, said user configurable settings comprise at least one setting selected from the group consisting of language, volume, speed, gender, pitch, and head size, and the plurality of user configurable settings are provided for display via a printer properties dialog box that permits the user to configure an output type for the content.

15. The text-to-speech output device of claim 14, wherein the output type is at least one of outputted speech to a speaker and outputted speech to a file.

16. The text-to-speech output device of claim 15, wherein the printer properties dialog box permits the user to configure a file format for the file.

17. The text-to-speech output device of claim 16, wherein the file format includes at least one among MP3, AVI, WAV, OGG, VOX, and WMA and other formats.

18. The text-to-speech output device of claim 13, wherein the driver filters textually formatted content from the content and the text-to-speech engine converts only the textually formatted content to speech data.

19. The text-to-speech output device of claim 13, wherein the at least one user-configurable setting includes at least one setting selected from the group consisting of language, volume, speed, gender, pitch, and head size.

* * * * *